US011629586B2

(12) United States Patent
Buchanan et al.

(10) Patent No.: US 11,629,586 B2
(45) Date of Patent: Apr. 18, 2023

(54) IN-LINE PHASE SEPARATION

(71) Applicant: EQUINOR ENERGY AS, Stavanger (NO)

(72) Inventors: Alastair Buchanan, Stavanger (NO); Ketil Pettersen, Stavanger (NO); Tor Kindsbekken Kjeldby, Stavanger (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 16/755,459

(22) PCT Filed: Oct. 12, 2018

(86) PCT No.: PCT/NO2018/050245

§ 371 (c)(1),
(2) Date: Apr. 10, 2020

(87) PCT Pub. No.: WO2019/074377

PCT Pub. Date: Apr. 18, 2019

(65) Prior Publication Data

US 2020/0332641 A1 Oct. 22, 2020

(30) Foreign Application Priority Data

Oct. 12, 2017 (GB) ..... 1716719
Jul. 13, 2018 (GB) ..... 1811556

(51) Int. Cl.
*E21B 43/38* (2006.01)
*E21B 17/20* (2006.01)
(Continued)

(52) U.S. Cl.
CPC ..... *E21B 43/38* (2013.01); *E21B 17/01* (2013.01); *E21B 17/20* (2013.01); *E21B 43/121* (2013.01); *E21B 47/06* (2013.01)

(58) Field of Classification Search
CPC ..... E21B 43/38; E21B 17/20
See application file for complete search history.

(56) References Cited

U.S. PATENT DOCUMENTS 4,926,937 A * 5/1990 Hademenos ..... E21B 23/01 166/206
5,033,545 A * 7/1991 Sudol ..... B08B 9/0433 166/312

(Continued)

FOREIGN PATENT DOCUMENTS

GB 2 326 895 A 1/1999
WO WO 98/28519 A1 7/1998

(Continued)

OTHER PUBLICATIONS

Extended European Search Report for European Application No. 18865782.9, dated May 26, 2021.

(Continued)

*Primary Examiner* — Abby J Flynn
*Assistant Examiner* — Yanick A Akaragwe
(74) *Attorney, Agent, or Firm* — Birch, Stewart, Kolasch & Birch, LLP

(57) ABSTRACT

A method of separating fluid phases in a well or riser. The method comprises: locating an inlet device of a flexible tubing at a substantially horizontal portion of the well or riser, wherein a portion of the flexible tubing extends into the well or riser and the flexible tubing terminates at the inlet device; biasing the inlet device against a wall of the well or riser; and extracting a stratified fluid phase from the well or riser through the inlet device and flexible tubing, wherein a shape of the inlet device is configured to match a shape of the wall.

13 Claims, 15 Drawing Sheets

(51) Int. Cl.

| | |
|---|---|
| ***E21B 17/01*** | (2006.01) |
| ***E21B 43/12*** | (2006.01) |
| ***E21B 47/06*** | (2012.01) |

(56) References Cited

U.S. PATENT DOCUMENTS

| | | | | |
|---|---|---|---|---|
| 5,080,560 | A | 1/1992 | LeRoy et al. | |
| 5,138,585 | A * | 8/1992 | Angehrn | G01V 1/46 73/152.55 |
| 5,588,486 | A * | 12/1996 | Heinrichs | B01D 19/0047 166/50 |
| 5,632,335 | A * | 5/1997 | Campbell | E21B 17/00 166/105 |
| 5,829,529 | A * | 11/1998 | Cholet | E21B 43/121 166/105.5 |
| 5,904,209 | A | 5/1999 | Kenworthy et al. | |
| 6,277,286 | B1 | 8/2001 | Søntvedt et al. | |
| 6,547,005 | B2 | 4/2003 | Haheim | |
| 2003/0010204 | A1 | 1/2003 | Molyneux et al. | |
| 2005/0045332 | A1 | 3/2005 | Howard et al. | |
| 2006/0150749 | A1 | 7/2006 | Eken et al. | |
| 2007/0169933 | A1 | 7/2007 | Heller et al. | |
| 2010/0155075 | A1 | 6/2010 | Holm | |
| 2012/0067569 | A1 | 3/2012 | Brown | |
| 2013/0098629 | A1 | 4/2013 | Wilson et al. | |
| 2013/0327535 | A1 | 12/2013 | Lamison | |
| 2015/0204169 | A1 | 7/2015 | Coates et al. | |
| 2016/0215587 | A1 | 7/2016 | Vavik | |
| 2016/0319653 | A1 * | 11/2016 | Reeves | E21B 43/121 |

FOREIGN PATENT DOCUMENTS

| | | | |
|---|---|---|---|
| WO | WO 2004/044370 | A2 | 5/2004 |
| WO | WO 2016/057126 | A1 | 4/2016 |

OTHER PUBLICATIONS

International Search Report for PCT/NO2018/050245 dated Dec. 21, 2018.
Priority Search Report for GB1716719.8 dated Feb. 20, 2018.
Priority Search Report for GB1811556.8 dated Jul. 31, 2018.
Written Opinion of the International Searching Authority for PCT/NO2018/050245 dated Dec. 21, 2018.

* cited by examiner

IN-LINE PHASE SEPARATION

TECHNICAL FIELD

The present invention relates to the separation of phases in produced hydrocarbon fluids, and in particular the downhole separation of such phases.

BACKGROUND

Concepts for downhole separation of oil/water have been under development for many years. However, none of these concepts have been materialized due to numerous uncertainties related to their robustness.

Existing concepts for downhole separation of oil/water rely on re-injection of water utilizing a well side branch and a separate water injection system (pump). Such a layout is technically complex and expensive. In addition, there is large uncertainty related to the quality of the water to be re-injected. A tiny fraction of oil contained in the water for re-injection may create problems and potentially plug the water injector.

SUMMARY

The present invention aims to solve or at least mitigate the above described problems, and, further, to provide a simple and efficient method and system for downhole (or in-pipe) separation of fluid phases. With reference to the separation of oil and water phases, the present invention does not rely on re-injection of the water. Instead, the separate phases, e.g. oil and water phases, are lifted in separated conduits towards the well head. With reference to the separation of oil and water phases, this solution eliminates the large uncertainties related to potential re-injection of the water.

In accordance with a first aspect of the present invention there is provided a method of separating fluid phases in a well or riser, comprising: locating an inlet device at a substantially horizontal portion of the well or riser, wherein a portion of a flexible tubing extends into the well or riser and the flexible tubing terminates at the inlet device; biasing the inlet device against an inside wall of the well or riser; and extracting a stratified fluid phase from the well or riser through the inlet device and flexible tubing, wherein a shape of the inlet device matches a shape of the inside wall.

Biasing the inlet device against the inside wall of the well or riser may comprise biasing the inlet device away from an opposing inside wall of the well or riser.

The inlet device may comprise a partially tubular outer wall, wherein the shape of the inlet device is an outer curvature of the partially tubular outer wall which matches an inner curvature of the inside wall of the riser or the well, and wherein the inlet device is biased against the inside wall of the well or riser such that the inlet device is flush with the inside wall of the well or riser.

The inlet device may have an at least partially oval cross section in radial direction of the flexible tubing.

The inlet device may comprise a jet pump which draws the stratified fluid phase that is to be extracted into the inlet device.

The inlet device may be biased against the inside wall of the well or riser using a spacer arranged to urge the end of the flexible tubing and/or the inlet device against the inside wall.

The inlet device may be biased against the inside wall of the well or riser using a weight that is arranged to urge the end of the flexible tubing and/or the inlet device against the inside wall.

The inlet device may be biased against a lower inside wall of the well or riser. The extracted stratified fluid phase may be a water phase or a water-and-condensate phase.

The inlet device may be biased against an upper inside wall of the well or riser. The extracted stratified fluid phase may be an oil phase or an oil-and-gas phase.

In accordance with a second aspect of the present invention there is provided a system for separating fluid phases in a well or riser, comprising: a flexible tubing extending into the well or riser and terminating at an inlet device, wherein the inlet device is located at a substantially horizontal portion of the well or riser and is biased against an inside wall of the well or riser; wherein a shape of the inlet device is configured to match a shape of the inside wall, and wherein the inlet device and flexible tubing are configured to extract a stratified fluid phase from the horizontal portion of the well or riser.

DETAILED DESCRIPTION

Hydrocarbons are typically extracted from a reservoir via a production well. Produced fluids located in such a production well typically include different phases, e.g. liquid hydrocarbons, gases, water and perhaps solids. Similar phases, or more typically gaseous hydrocarbons and water/condensate phases, may be located in a production riser. In horizontal, near-horizontal or low portions of a well or riser the fluid velocity is typically low, and the fluids may naturally stratify under the influence of gravity. For example, flowing oil/water phases may be separated by gravity before reaching an inclined or vertical part of the well. These considerations also apply for horizontal portions of a flowline, riser, or riser base. This natural stratification provides an opportunity for the simple downhole (or in a pipe) separation of different fluid phases in accordance with the invention. This avoids the difficulties associated with typical phase separation processes, which are carried out in more mixed/turbulent flow regimes. In particular, in the inclined/vertical part of a well the oil/water stratified flow regime disappears and a dispersed flow regimes results. These dispersions are further transported through various chokes and process equipment before reaching topside and the process plant. Separating a heavily mixed oil/water dispersion/emulsion topside can be very challenging and costly. Thus, being able to separate oil and water under stratified downhole conditions may be advantageous. Mixing of oil and water is avoided, and issues with emulsions are thereby avoided. Any subsequent topside separation processes are therefore made simpler. The invention is suitable for field layouts with subsea or topside well heads.

Figure 1:
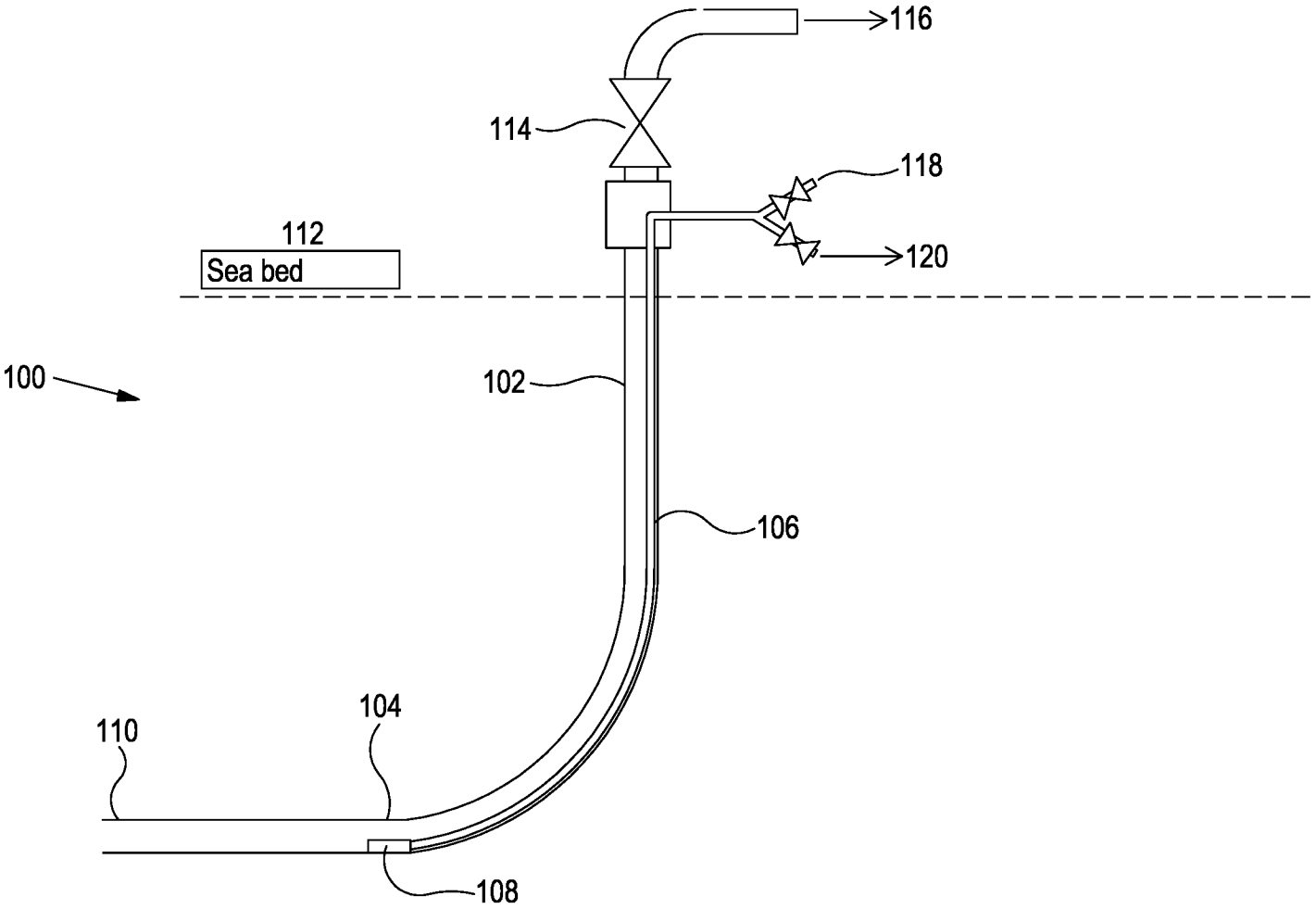
FIG. 1 shows a system for downhole separation of fluid phases.

FIG. 1 shows a system 100 for downhole separation of oil and water in a hydrocarbon production well 102. Whilst the specific example of FIG. 1 relates to a well, the inlet device, flexible tubing and other downhole components as described below in relation to a well may be used in a riser, flowline or any other tubular in which fluid phase separation is desirable. Further, the mode of operation as described below in relation to a well will be substantively the same in a riser or flowline. Therefore, references to a well below apply equally to a riser or flowline, except where precluded by structural or operational differences that will be understood by the skilled person. The well 102 extends into a formation below a sea bed 112, and the well has an oil and water inflow zone 110. In a horizontal portion 104 of the well the velocity of produced fluids in the well is typically low. The produced fluids include oil and water from the oil and water inflow zone. With a sufficiently low fluid velocity the fluids separate into different phases under the influence of gravity. In particular, the produced fluids separate into oil and water phases. In accordance with the invention, a portion of the well is considered to be horizontal if the fluid velocity in the portion of the well is low enough to allow phase stratification under the influence of gravity, i.e. the horizontal portion may be a near-horizontal or low portion of the well. Flexible tubing 106, which is e.g. coiled tubing, extends into the well and terminates at an inlet device 108 in the horizontal portion 104 of the well. The design of the inlet device is refined to capture liquid advected from an upstream region, i.e. from the well inflow zone towards the well head. Concentric coiled tubing, or alternatively dual/parallel strings of coiled tubing bonded together, may be used. Combinations of coiled tubing and regular pipe-in-pipe may also be used. The inlet device 108 and flexible tubing 106 are for extracting a stratified fluid phase from the horizontal portion of the well.

The inlet device 108 is biased against a wall of the well, and away from an opposing wall of the well, and is preferably in close contact with the wall. The inlet device may be biased against a lower/bottom wall of the well under the influence of gravity. In this case, the inlet device has a weight and density sufficient to maintain biasing of the inlet device under the influence of gravity in the flow and fluid conditions within the well. A specific example of the weight of the inlet device is 100 kg for a 40 cm internal diameter well. The connection between the flexible tubing and the inlet device may be a swivel connection to allow the assembly to move past bends, or alternatively the connection may be a fixed connection. Alternatively or additionally, various mechanical means can be provided, if necessary, for urging the inlet device against the wall. One option can be a heavy weight which is attached to the end of the flexible tubing at or near the inlet device and which urges the end of the flexible tubing towards the lowest part of the well. Another example is a spacer which extends from the flexible tubing or inlet device to the opposite internal well wall to urge the flexible tubing against the well wall. Examples of spacers are simple mechanical devices such as a mechanical spring or extendable rod. Optionally, the spacers can be activated remotely but that will require communication lines and control units which will add costs to the setup.

In the specific example shown in FIG. 1 the inlet device 108 comprises a jet pump. The jet pump uses high-pressure power fluid 118, for example water, to create a pressure differential using the Venturi effect, to thereby draw fluid into the flexible tubing and out of the well. Such jet pumps are known to the skilled person. The jet pump power water is supplied from a high-pressure water injection line to a coiled tubing power fluid line. The power fluid line is a separate tube that may be contained within the flexible tubing or may extend into the well separately from, or coupled to, the flexible tubing. The fluid extracted from the horizontal portion of the well through the inlet device and flexible tubing is output from the flexible tubing to a low-pressure flow line, which in the specific example in FIG. 1 is on or near the seabed. The arrow adjacent to reference numeral 120 illustrates the flow of produced formation water and/or oil and/or gas and 'used' power water from the coiled tubing to the low-pressure fluid line. The extracted fluid includes fluid from a stratified phase in the horizontal portion of the well and 'used' power fluid. Wellhead equipment 114, which is at or near the seabed in the specific example shown in FIG. 1, may include a Christmas tree. The produced fluids remaining after the extraction of a separated phase are routed out of the well and through the wellhead equipment 114 to a high-pressure flow line 116. Thus the arrow adjacent to reference numeral 116 illustrates production from the well tubing to the high-pressure flow line.

No jet pump may be necessary if the downhole pressure is large enough to drive fluids up the flexible tubing. In this case, the separated phase may be extracted via the inlet device and flexible tubing using natural lift provided by downhole pressure.

Figure 2A:
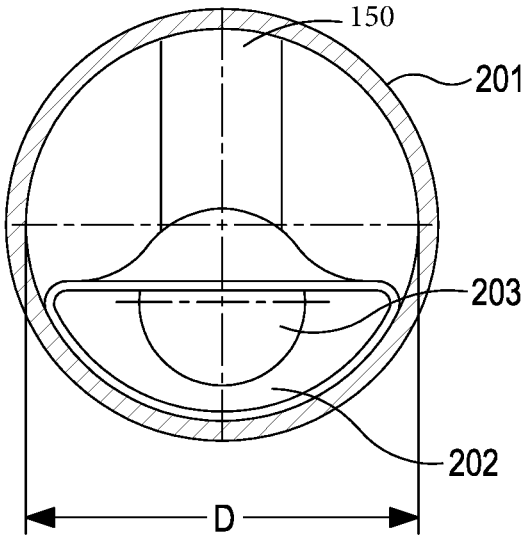
FIG. 2*a* is a radial cross section through a well with an inlet device.
Figure 2B:
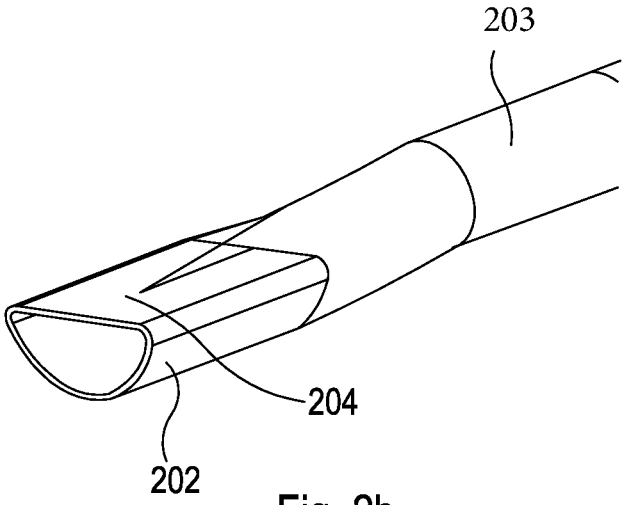
FIG. 2*b* is a perspective view of an inlet device and tubing.

FIGS. 2*a* and 2*b* shows a specific example of an inlet device, and in particular a shape of the inlet device that is matched to a shape of the inner wall of the well. FIG. 2*a* illustrates a radial cross section through a well 201 in which an inlet device 202 and flexible tubing 203 are provided. FIG. 2*b* illustrates a perspective view of the inlet device and flexible tubing. As illustrated, the inlet device is biased against the inner wall of the well by gravity. Alternatively, the inlet device can be biased against the upper inside wall by a spacer (e.g., 150 in FIG. 2*a*), springs or other biasing means. The lower part of the inlet device has a curvature which matches the curvature corresponding to inner diameter D of the well. As a result, the lower part of the inlet device is flush with the inner wall of the well. A stratified fluid phase which is present at the lower part of a horizontal portion of the well will be drawn into the inlet device when the flexible tubing is at a lower pressure than the riser, or when the inlet device includes an operating jet pump. It is noted that FIGS. 2*a* and 2*b* does not show a jet pump, or any jet pump features or components, that may be included in the inlet device. The upper part 204 of the inlet device is flat so as to reduce the amount of a different stratified fluid phase present in the upper part of the horizontal part of the well. The upper part of the inlet device can also have other shapes than the flat shape illustrated in FIGS. 2*a* and 2*b*, for example a convex or concave shape.

The urging of the inlet device against a wall of the well and the matching of the shape of the inlet device with the inner wall shape facilitates the efficient extraction of a stratified fluid phase. In particular, the location of the inlet device close to an inner wall of the well (and away from the opposite wall) in a horizontal portion of the well, and preferably within one of the stratified phases, means that one of the stratified phases (which may itself contain one or more dispersed phases) can be easily separated and extracted. In an embodiment in which a stratified water phase is separated from a stratified oil phase, the water can be lifted directly up to the water treatment topside without being mixed into the oil.

Figure 3:
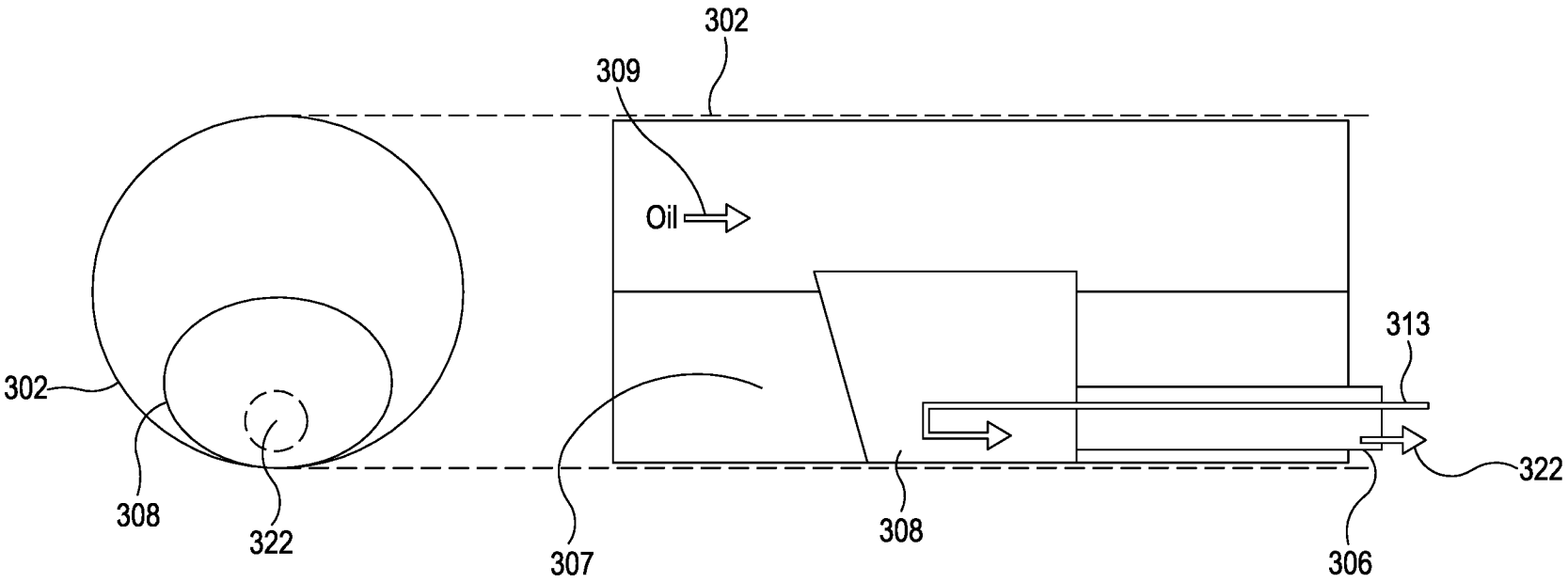
FIG. 3 shows an inlet device and flexible tubing in a horizontal portion of a well for extraction of a water phase.

FIG. 3 shows an example in which the inlet device 308 and flexible tubing 306 is used to extract a stratified water phase 307 from a horizontal portion of the well 302, thus separating the water phase from a stratified oil phase 309. The water phase 307 may be formation water. The inlet device 308 is biased against the lower wall of the well under the influence of gravity. The inlet device includes a jet pump. Power fluid 313 is supplied to the jet pump, and a combination 322 of the separated water phase and the used power fluid is extracted out of the well via the flexible tubing 306.

Figure 4:
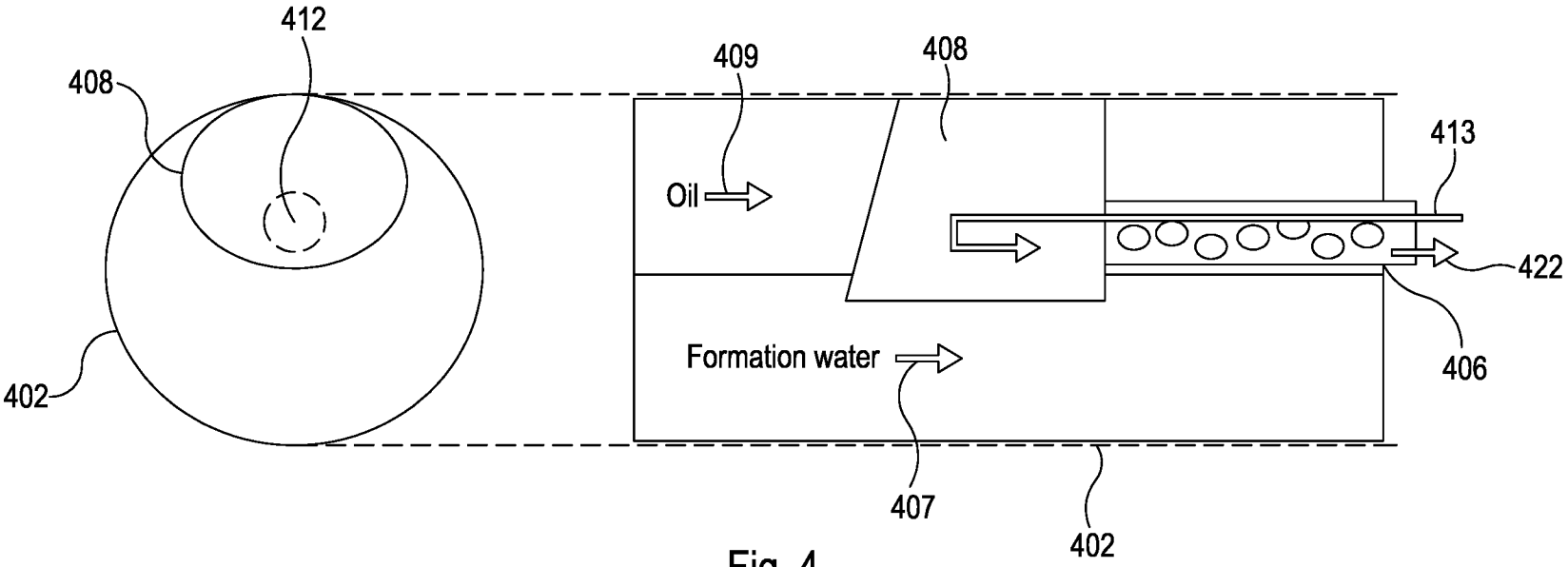
FIG. 4 shows an inlet device and flexible tubing in a horizontal portion of a well for extraction of an oil phase.

FIG. 4 shows an example in which the inlet device 408 and flexible tubing 406 is used to extract a stratified oil phase 409 from a horizontal portion of the well 402, thus separating the oil phase from a stratified water phase 307. The inlet device 408 is biased against the upper wall of the well, for example using mechanical means as set out above in relation to FIG. 1. The inlet device includes a jet pump. Power fluid 413 is supplied to the jet pump, and a combination 422 of the separated oil phase and the used power fluid is extracted out of the well via the flexible tubing 406. In this case further separation of the oil phase and the power fluid, which is typically water, will be required at a later stage, for example at a processing facility at or near the wellhead.

Figure 5:
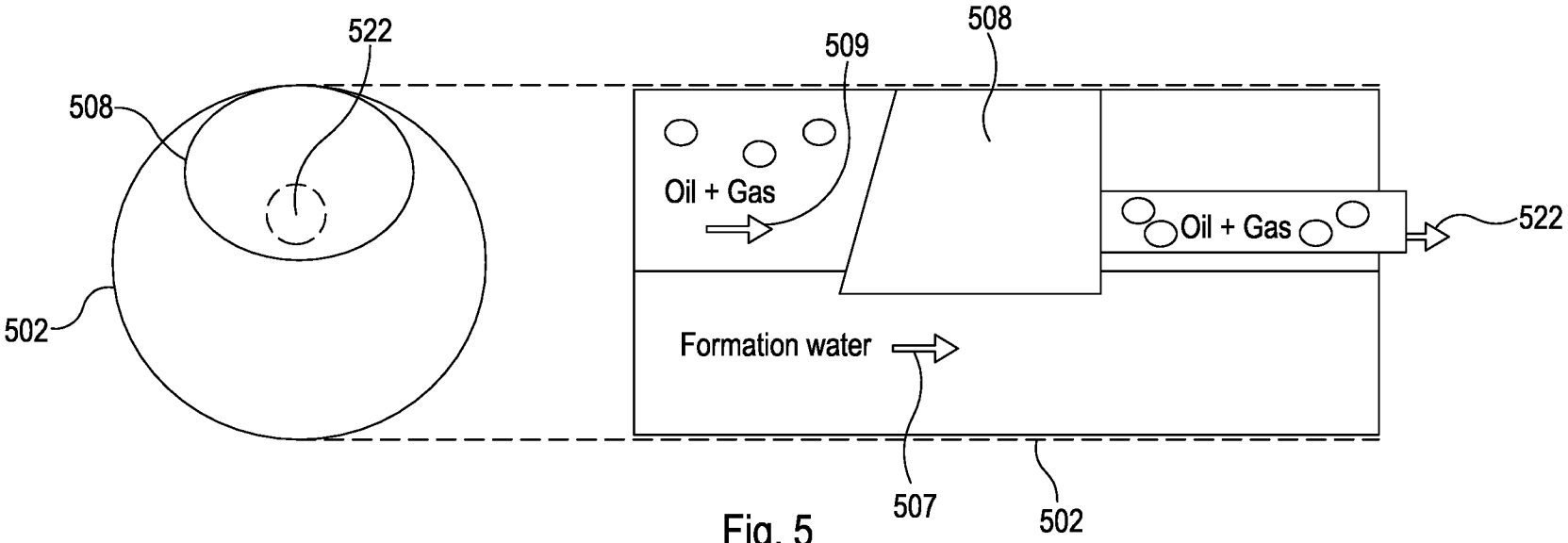
FIG. 5 shows an inlet device and flexible tubing in a horizontal portion of a well for extraction of an oil phase containing gas.

FIG. 5 shows an example in which the inlet device 508 and flexible tubing 506 is used to extract a stratified oil phase 509, which includes entrained gas, from a horizontal portion of the well 502, thus separating the oil phase from a stratified water phase 507. The inlet device 508 is biased against the upper wall of the well, for example using mechanical means as set out above in relation to FIG. 1. In this example the inlet device does not include a jet pump. In this case, extraction of the oil phase is reliant on natural gas lift in the flexible tubing from the gas entrained in the oil phase. Alternatively or additionally, a pressure differential across the flexible tubing may be created by connecting the flexible tubing to a low-pressure stage of topside or oilfield processing equipment.

Figure 6:
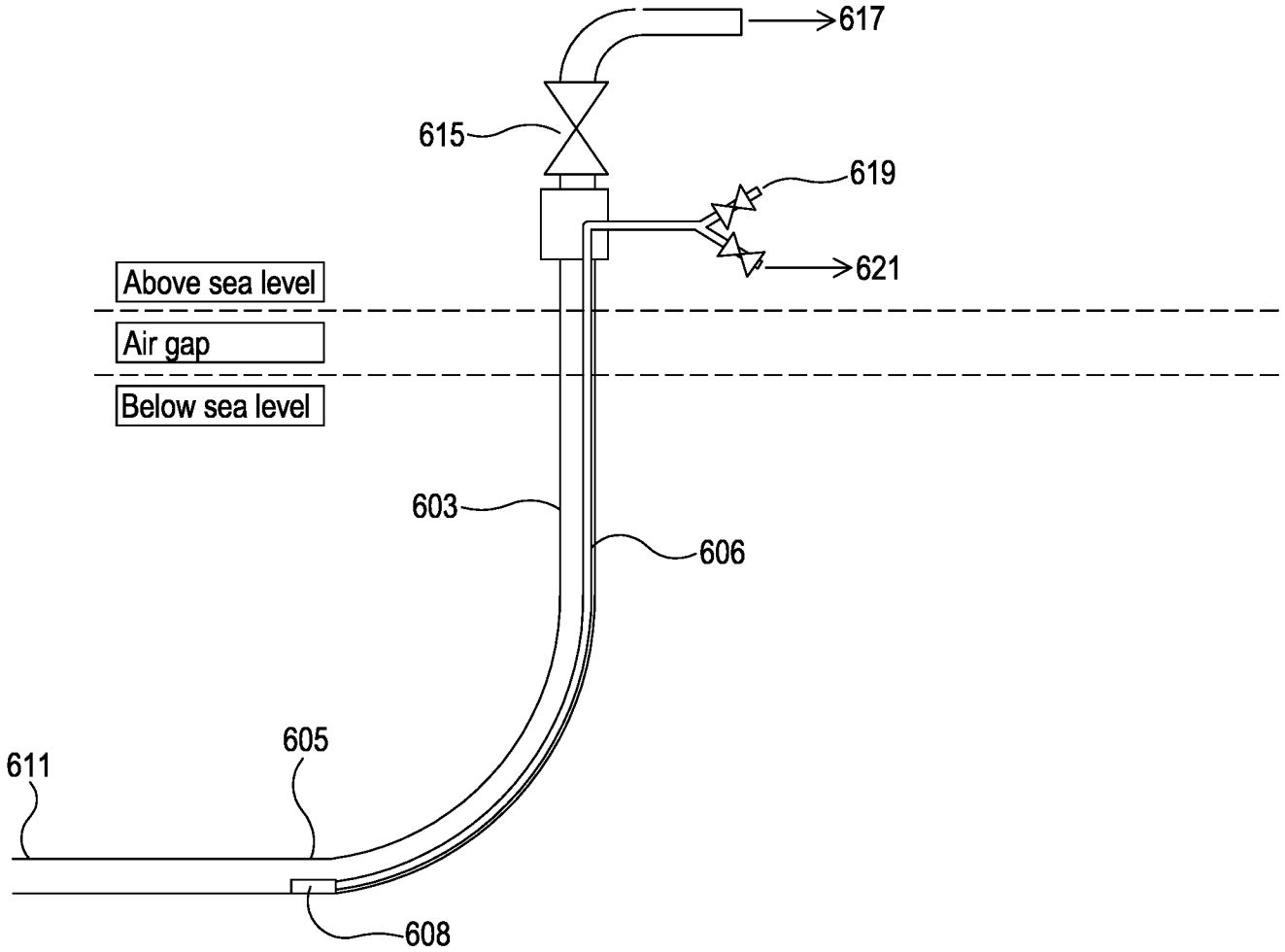
FIG. 6 shows a system for separation of fluid phases at a riser base.

FIG. 6 shows a system 600 for downhole separation of produced liquid, i.e. water and/or condensate, and gas in a hydrocarbon production riser 603. A production flowline 611 leads to a riser base 605, which is horizontal in accordance with the definition set out above for FIG. 1. The riser base leads to production riser 603. Production riser 603 is a subsea riser that terminates above sea level, for example at a production choke 615. Produced hydrocarbon gas 617 is routed up through the riser and the production choke to a first-stage separator. Flexible tubing 606 extends down through the riser 603 and terminates at an inlet device 608 which is located at the horizontal portion of the riser base 605. The design of the inlet device is refined to capture liquid advected from an upstream region i.e. from the flowline towards the riser base. The inlet device and flexible tubing are as described for FIGS. 1 to 3 and may be used in the same way. In the specific example shown in FIG. 6 the inlet device 608 includes a jet pump. The supply of power fluid 619 to the jet pump differs from the description in relation to FIG. 1 in that the power fluid, e.g. power water, is supplied from a high-pressure water injection pump to the coiled tubing power fluid line. The extraction of the produced liquid and power water 621 can be made more efficient by connecting the outlet line (which is above sea level) to a topside boundary condition with a pressure that is lower than the first-stage separator pressure. The separation of liquid/condensate in this way may provide an efficient surge wave mitigation tool for flowline-riser systems, in addition to reducing the riser pressure drop under steady state production.

The inlet device and flexible tubing of the invention, where the inlet device includes a water-driven jet pump, could also be used to lift liquid from risers in gas dominated systems, with the purpose of mitigating flowline/riser surge wave instabilities in addition to reducing well and riser pressure drop under steady state operation.

Figure 7:
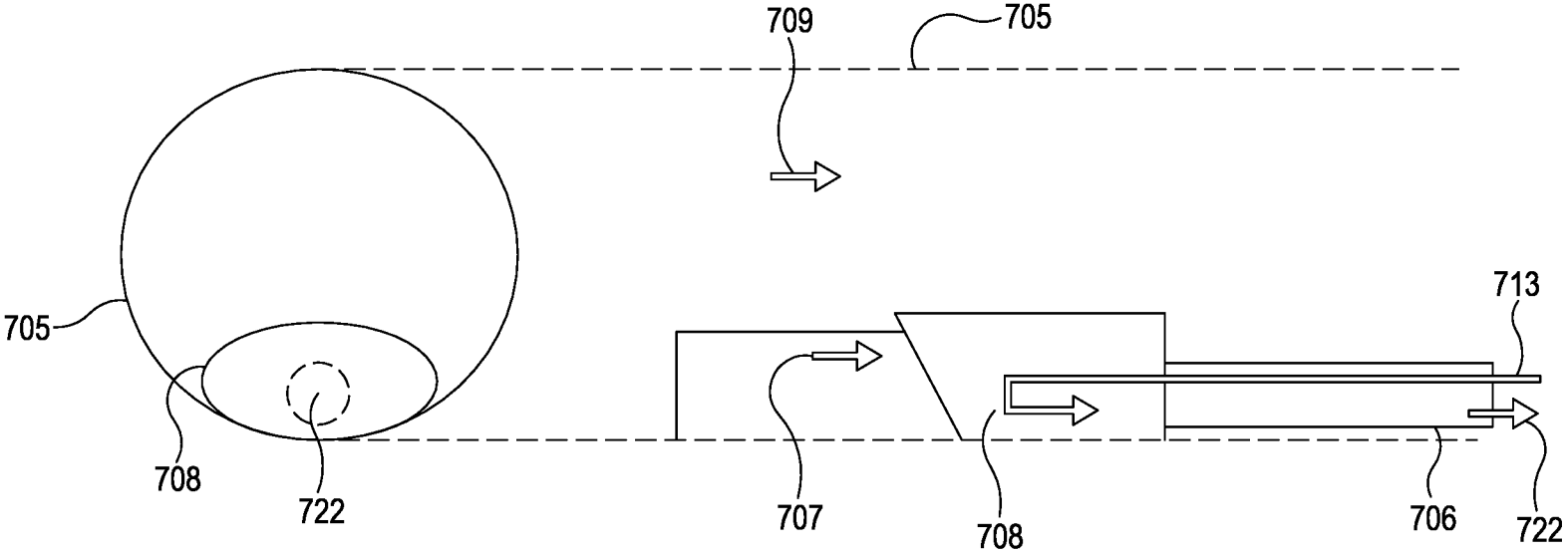
FIG. 7 shows an inlet device and flexible tubing in a horizontal portion of a riser base for extraction of a water and/or condensate phase.

FIG. 7 shows a closer view of the inlet device of FIG. 6 in situ. The inlet device 708 and flexible tubing 706 is used to extract a stratified water and/or condensate phase 707 from a horizontal portion of the riser base 705, thus separating the water and/or condensate phase from gas 709. The inlet device 708 is biased against the lower wall of the well under the influence of gravity. The inlet device includes a jet pump. Power fluid 713 is supplied to the jet pump, and a combination 722 of the separated water and/or condensate phase and the used power fluid is extracted out of the well via the flexible tubing 706.

Figure 8:
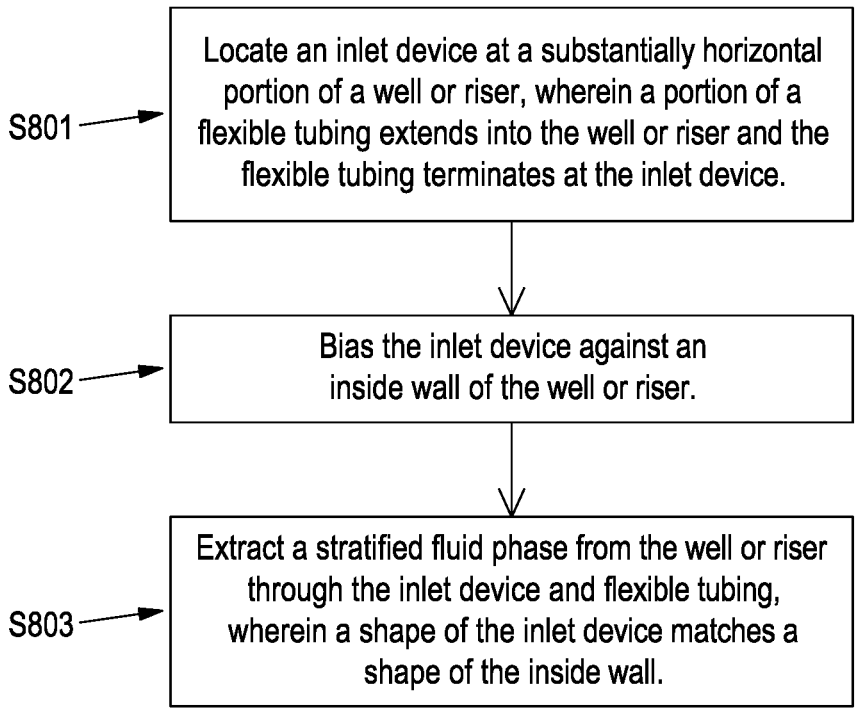
FIG. 8 shows a high-level flow diagram for a method.

FIG. 8 shows a high-level flow diagram describing a method of separating fluid phases in a well or riser in accordance with the invention. In step 801 an inlet device is located at a substantially horizontal portion of the well or riser, wherein a portion of a flexible tubing extends into the well or riser and the flexible tubing terminates at the inlet device. In step 802 the inlet device is biased against an inside wall of the well or riser. In step 803 a stratified fluid phase is extracted from the well or riser through the inlet device and flexible tubing, wherein a shape of the inlet device matches a shape of the inside wall.

The inlet device (optionally with jet pump) and flexible tubing could alternatively be positioned in an upper part of a well tubing cross section. With such a configuration water will flow in the annulus while the oil phase and/or the gas phase will be transported in the flexible tubing.

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

To provide a better understanding of the present invention and for background only, an example of a system for protecting a riser and production facility against liquid surges is set out below:

Herein disclosed is a system which can be used for protecting a riser and production facility against liquid surges. The riser is used for transporting gas and liquid from a flowline located at the sea bed to a production facility. The riser contains liquid and gas and at low gas flow rates the liquid may accumulate and move in a wave-like manner downstream. Flexible tubing is provided which extends partially into the riser and which ends inside the riser. A pressure differential within the flexible tubing is provided such that any liquid in the area where the tubing ends is drawn into the flexible tubing and is transported up. The liquid can be transported to a container which is kept at a lower pressure than the area within the riser where the tubing ends. The amount of liquid which is drawn into the tubing can be controlled by a regulating valve provided between the tubing and the container. Alternatively, a pump can be provided which controls the amount of liquid drawn into the flexible tubular.

The riser will in a typical arrangement not only extend upwards continually from the flowline in a straight way, but the riser will have several areas with bends and local dips where fluids can accumulate. The end of the flexible tubular can be placed in such a bend or a local dip to draw the liquid out of that area. By removing the liquid from the riser a surge of liquid in which collected liquid suddenly moves upwards can be prevented. If the amount of liquid accumulating in one area is large enough to take up the entire cross sectional area then a liquid plug can be formed which blocks the flow of gas and causes fluctuations of pressure. The flexible tubing can be extended into the plug such that the plug of liquid can be removed by suction from the flexible tubing.

However, also without local depressions of the riser where liquid can accumulate as a plug there can be a problem of liquid surging. Gas condensate typically accumulates along the walls of the riser while the central area of the riser remains free for gas to flow through. By way of example, liquid condensate along the walls can occupy from 5% to 20% of the cross sectional area. This problem occurs also in risers which extend continuously upwards. The liquid will move upwards under the influence of the upwards gas flow through the centre of the riser. The upwards movement of the liquid is not a stable process due to the opposite forces of gravity and friction of the riser walls, and the instability causes waves of liquid and liquid surging instead of a steady flow. The flexible tubing is used to remove the liquid to reduce the cross sectional area taken up by fluid and to reduce the overall amount of fluid, thereby mitigating the liquid surging.

The end of the flexible tubing within the riser is preferably in contact with the riser walls, especially when gas flows through the centre of the riser and gas condensate is accumulated along the walls. Various mechanical means can be provided for urging the tubing against the riser inner walls. One option can be a heavy weight or inlet device which is attached to the end of the flexible tubing and which urges the end of the flexible tubing towards the lowest part of the riser. This example of a heavy weight or inlet device works best if the riser has a significant horizontal component. Another example is a spacer which extends from the flexible tubing to the opposite internal riser wall to urge the flexible tubing against the riser wall. Examples of spacers are simple mechanical devices such as a mechanical spring or extendable rod. Optionally, the spacers can be activated remotely but that will require communication lines and control units which will add costs to the setup.

In a specific example, the portion of the flexible tubing which is outside the riser is stored on a reel which can also be used to vary the length of the portion of the flexible tubing extending into the riser. The length of the portion of the tubing extending into the riser can also be actively controlled by a feedback system depending on a detected amount of fluid in the flexible tubing. When a larger amount of fluid is present, the flexible tubing can be pulled up by rolling up the reel or by any other lifting mechanism. Alternatively, the tubing can be left in place if a large amount of fluid is detected within the tubing. If a small amount of fluid or no fluid is detected inside the flexible tubing, the tubing can be extended to reach further into the riser and remove liquid at a section of the riser closer to the well. This feedback system can be automated and be controlled by a computing system, or it can be carried out manually. The active control system enables continuous lifting of the gas and liquid mixture from the riser base to the topside.

The variable length of the flexible tubing can also be utilised to initiate the flow within the flexible tubing. The pressure differential required for starting the flow of a large amount of fluid from a location low in the riser can be relatively large. The required pressure differential can be reduced by raising the intake point of the flexible tubing for starting the flow, and lowering the intake point after the flow has started to the desired location.

Different methods can be used for detecting the presence of fluids in the flexible tubing, such as standard optical or acoustic methods, or a gamma densitometer clamped onto the coiled tubing topside. Alternatively, the pressure within the flexible tubing near the control valve can be detected, and a drop in pressure will indicate an increase of the amount of gas and a decrease of the amount of fluid.

An advantage of this arrangement is that it will be efficient to implement on platforms with coiled tubing equipment already in place. At such a platform, coiled tubing is connected to an available low-pressure tank via a control valve. This allows for drawing liquid up from the riser base. The optimal pressure in the low-pressure tank depends on the depth of the riser base and the pressure within the riser. The pressure difference between riser base process and the low-pressure tank determines the driving potential for the liquid extraction.

A plurality of separators can be used in stage separation of the hydrocarbons. The first separator, called the first-stage separator, typically has the highest pressure and the operating pressure is sequentially reduced in each successive separator. The flexible tubing will be able to carry out a suction function if the pressure inside the flexible tubing is lower than the pressure inside the riser. This pressure difference can be achieved by connecting the flexible tubing to a separator which has a lower pressure than the nearest separator to which the riser is connected. In one example, the riser section is directly connected to a first-stage separator, and the flexible tubing is connected to a second-stage separator.

A variable pressure differential can be applied to the flexible tubing, for example with a pump or with pressure control facilities provided at the separator. The variable length of the flexible tubing and the variable pressure provide two controls which can be used together or independently to control the intake of fluids into the flexible tubing.

The flexible tubing can be installed for surge protection within a riser. Alternatively, the flexible tubing can be installed inside the tubing in a gas-condensate well. Gas-condensate wells may also become unstable and ultimately need to be abandoned due to liquid accumulation. The methods described herein are applicable to a well and the hydrodynamics are similar when compared to a riser. However, if the well has its well head located at the sea bed there may not be a low pressure separator or a high pressure separator available for connection to the coiled tubing well-head-end and well head tubing, respectively. In such a setup, the well-head-end of the coiled tubing could be connected to a low pressure subsea flowline, while the well tubing could be connected to a separate flowline located at a higher pressure. If the well head is located above sea level, i.e. on a well head platform, coiled tubing and well tubing could be connected to low pressure and high pressure separators respectively, as described for a riser setup. In some gas-condensate wells the major portion of liquid to be removed deep in the well is liquid which flows downwards from an upper part of the well due to condensation in the upper part of the well. In an example described in more detail below, the intake device is designed differently to capture the condensing liquid flowing downward instead of being designed to capture liquid flowing upwards from the reservoir.

One particular example of flexible tubing for gas-liquid flow is coiled tubing. A suitable coiled tubing diameter is selected to optimise the amount of liquid being extracted while minimising the amount of gas being taken into the coiled tubing. If a thin layer of liquid is present along the walls then a corresponding small-diameter coiled tubing is selected. If the tubing is connected to a low pressure tank that is not part of the regular separation process (such as a second or higher stage separator), then the extracted gas and liquid mixture is pumped back into the process using a small multiphase pump. If the gas flow rate in the flexible tubing is too high for a multiphase pump, then a small compressor is used in parallel to a separate liquid pump. If the output of the coiled tubing is connected directly to a second or third stage separator no pump or compressor will be required, but only a control valve.

The flexible tubing allows for a pigging operation by simply extracting the flexible tubing from the riser completely and returning the flexible tubing after the operation has been completed.

Figure 9:
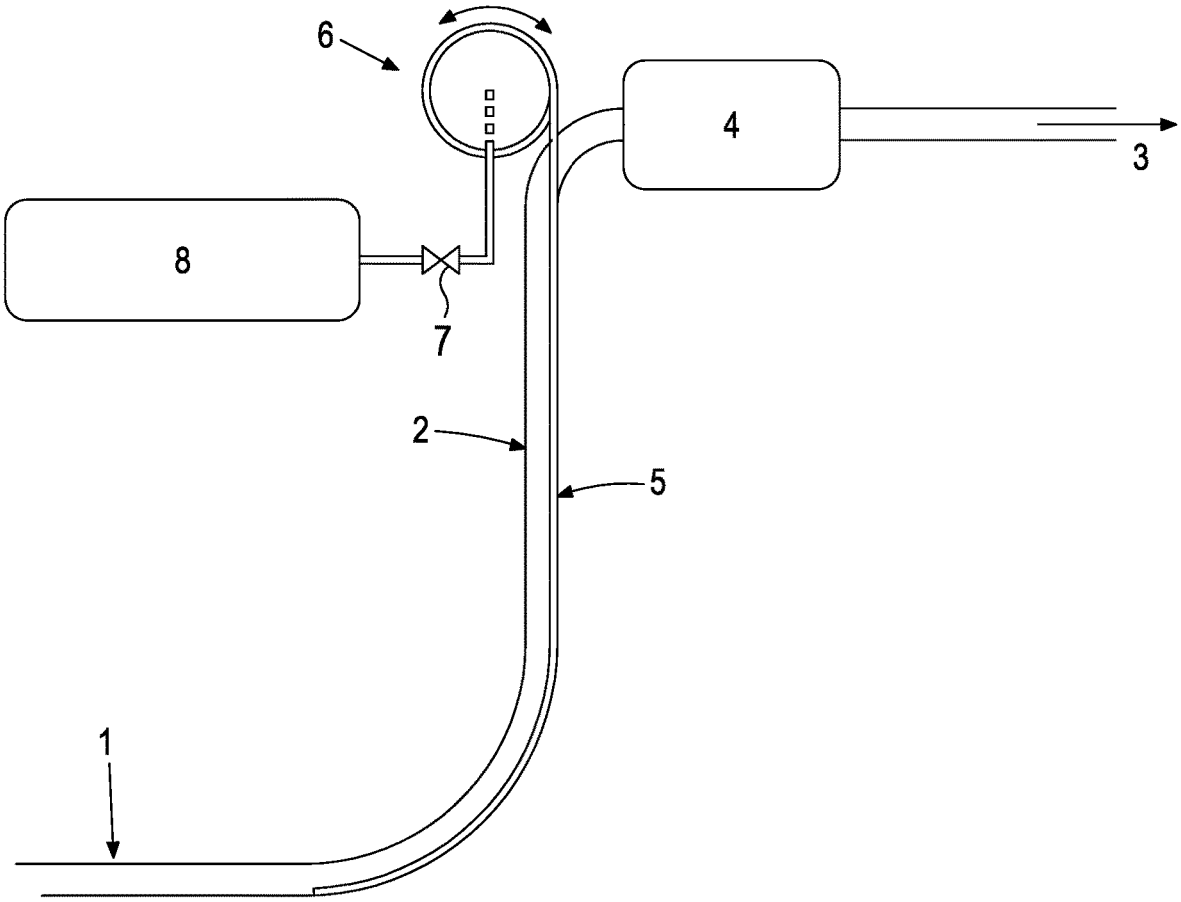
FIG. 9 illustrates a surge protection system.

FIG. 9 illustrates a flowline 1 and a riser 2 which carry gas and liquids in a direction 3 towards a processing facility. A first stage separator 4 is used. The pressure at the first stage separator is 20 Bar(a). A coiled tubing 5 extends into the riser and is arranged to draw fluid from the lowest part of the riser 2. The coiled tubing 5 is provided on a reel 6 outside the riser. The reel 6 can be used to wind and unwind the coiled tubing, corresponding respectively to reducing and extending the amount of the coiled tubing extending into the riser 5. A valve 7 controls the flow of fluid from the coiled tubing towards a low pressure tank 8. The low pressure tank is kept at a pressure of around 2 Bar(a), while the pressure at first stage separator 4 is 20 Bar(a).

The fluid is pumped from the low pressure tank to a further part of the process, such as a second stage separator (not illustrated). Alternatively, low pressure tank 8 can be a separator, such as a $2^{nd}$ stage, a $3^{rd}$ stage or higher stage separator.

Figure 10:
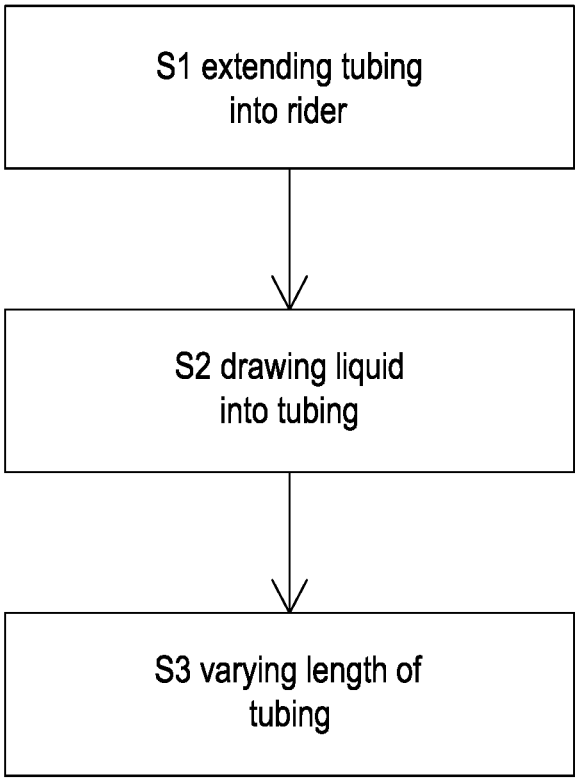
FIG. 10 illustrates a method.

FIG. 10 illustrates a method disclosed herein. The method includes the steps of: S1, extending a portion of flexible tubing into the riser; S2, drawing liquid from the riser into the flexible tubing if liquid is present in the riser by creating a pressure differential within the flexible tubing with a pressure control system; and S3, varying the length of said portion of the flexible tubing depending on the amount of liquid drawn into the flexible tubing.

The system described herein allows for reduction of the risk of a surge wave formation. The system can be used to extend the lifetime of gas-condensate fields. Without proper methods for surge mitigation, flowlines may need to be abandoned due to severe surge instabilities. Being able to efficiently remove liquid from the flowlines by way of the present system prevents surge instabilities partly or completely, thereby enabling continued production.

Figure 11:
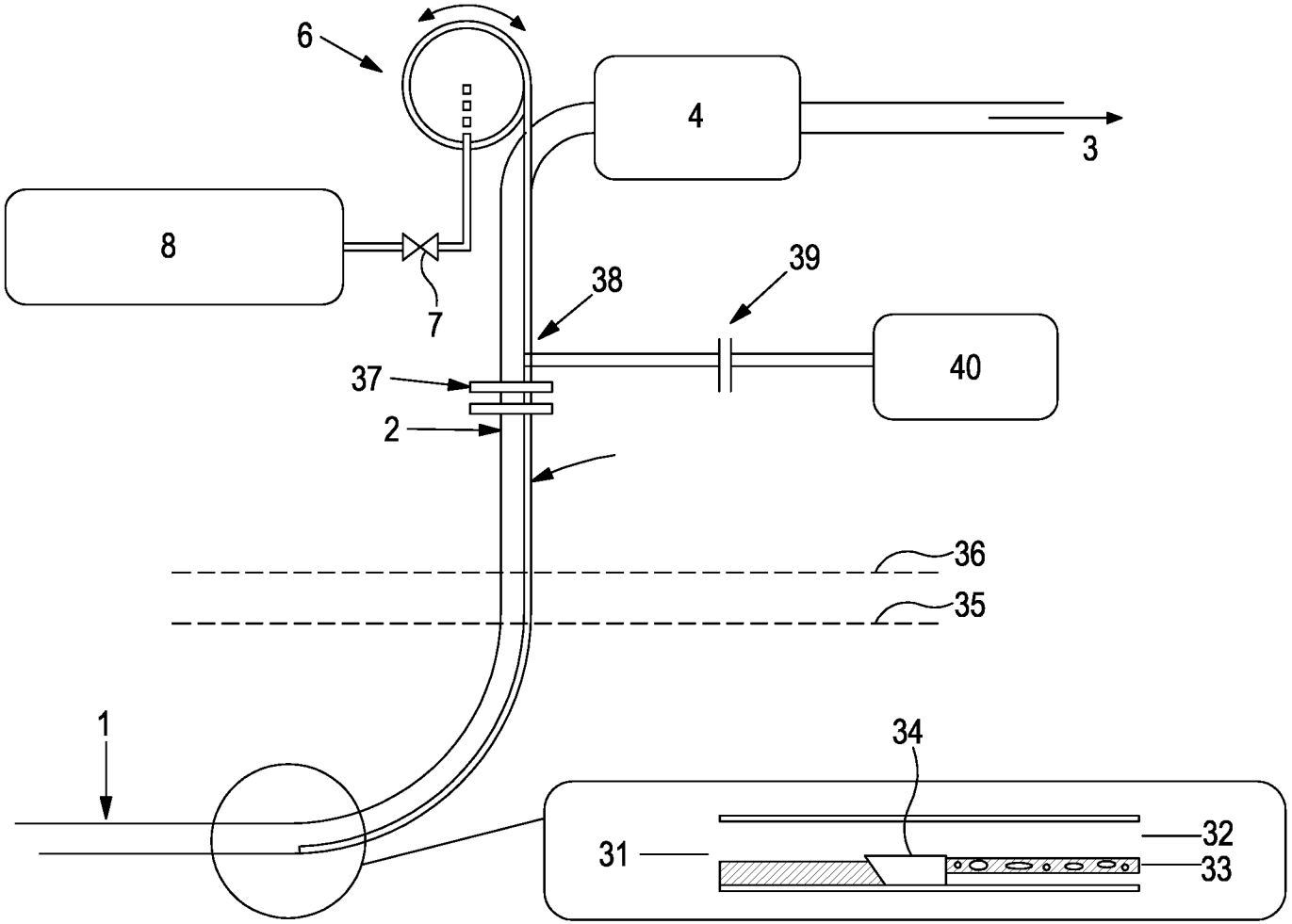
FIG. 11 illustrates a surge protection system.

In some examples it is beneficial to terminate the coiled tubing at a topside location and hang off the coiled tubing in a coiled tubing hanger arrangement placed inside the riser. FIG. 11 illustrates an arrangement similar to the arrangement of FIG. 9, wherein the same reference numbers are used for the same features. The inset illustrates schematically a flow 31 within flowline 1 wherein the flow includes gas and a liquid condensate against the lower inner surface. A gas flow 32 will enter the riser and a mixture of gas and liquid 33 will flow upwards within flexible tubing. Line 35 illustrates the interface between the sea level and an air gap, while line 36 illustrates the interface between the airgap and the topside. A connection 37 is provided which connects the riser 2 to the topside piping. At a position along the topside piping indicated with arrow 38 the flexible tubing is cut and the section of flexible tubing above arrow 38 is removed. A pipe exits the topside piping towards control unit 40, which may include low pressure tank 8 (in which case elements 8 and 40 in FIG. 11 would be combined) or a different pressure control device. This arrangement enables use of the coiled tubing system without routing the gas-liquid mixture lifted from the riser via the reel. The arrangement without the reel has fewer components and has a reduced risk of leaks when compared to a system with a reel, and is therefore more likely to be approved as a permanent part of a production system. The initial arrangement can then also be set up using a reel located on a ship. When the flexible tubing has been inserted into the riser, the flexible tubing can be terminated topside and can be attached to the tubing, referred to as 'hanged off', and the ship can sail away with the reel. When the length of the flexible tubing is fixed, the amount of liquid being drawn into the flexible tubing can be controlled by setting the pressure inside the flexible tubing. A choke valve to a higher stage separator can be used to set the pressure, or the speed of a multiphase pump can be used as a control parameter.

Figure 12:
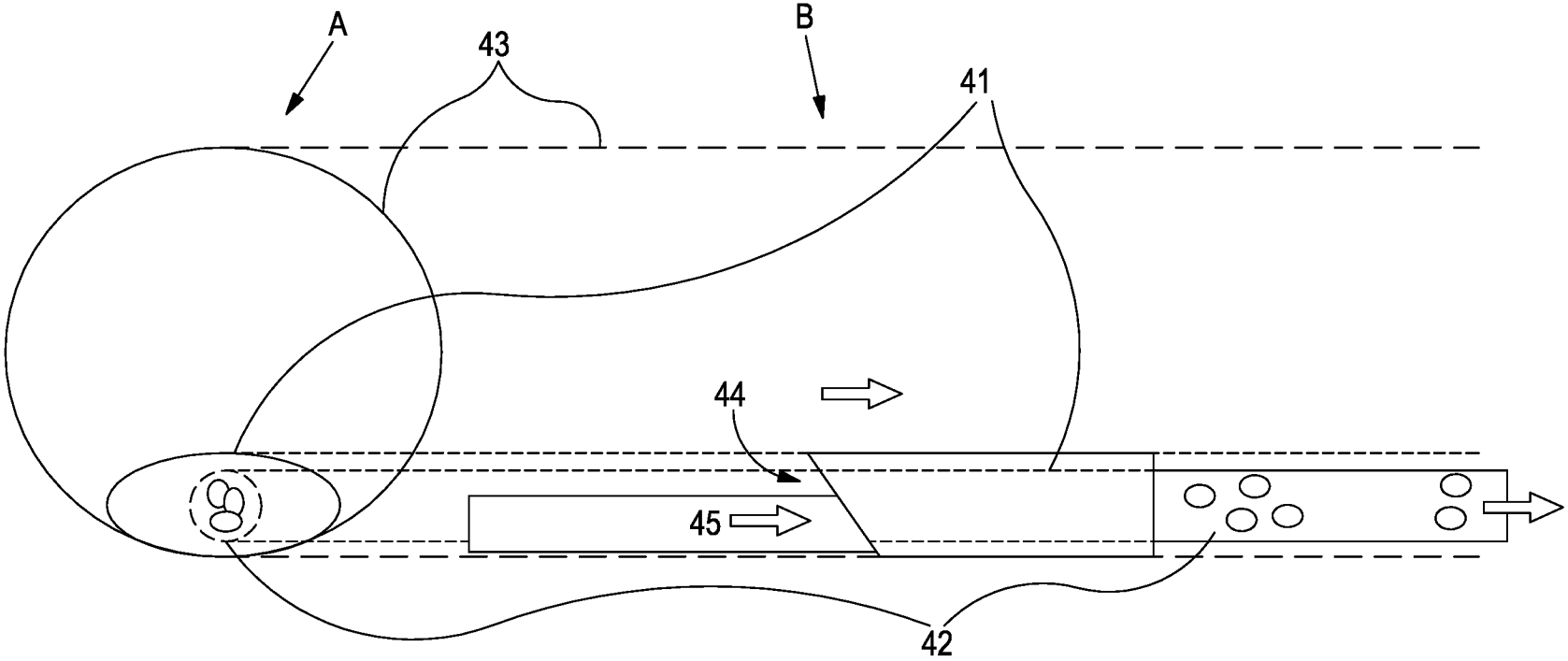
FIG. 12 illustrates a surge protection system.

FIG. 12 illustrates a specific example of an intake device in more detail. The intake device 41 is attached to the end of the flexible tubing 42. The flexible tubing can be coiled tubing. Part A of FIG. 12 is a cross section in radial direction of the riser and part B is a cross section of the riser (or flowline) 43 in axial direction. As shown in part A, the cross section of the intake device in radial direction shows an oval shape such that the area in which the intake device is in contact with the inside wall of the riser is larger than if the intake device had a circular cross section like the flexible tubing 42. Single phase gas flows through the riser and partially into the intake device as illustrated with arrows 44. A liquid film is drawn into the intake device as indicated by arrow 45. The flexible tubing will contain a mixture of gas and liquid. The intake device of the illustrated example is urged against the lower inside wall of the riser by the weight of the intake device. A specific example of the weight of the intake device is 100 kg for a 40 cm internal diameter riser. The connection between the flexible tubing and the intake device may be a swivel connection to allow the assembly to move past bends, or alternatively the connection may be a fixed connection.

Figure 13:
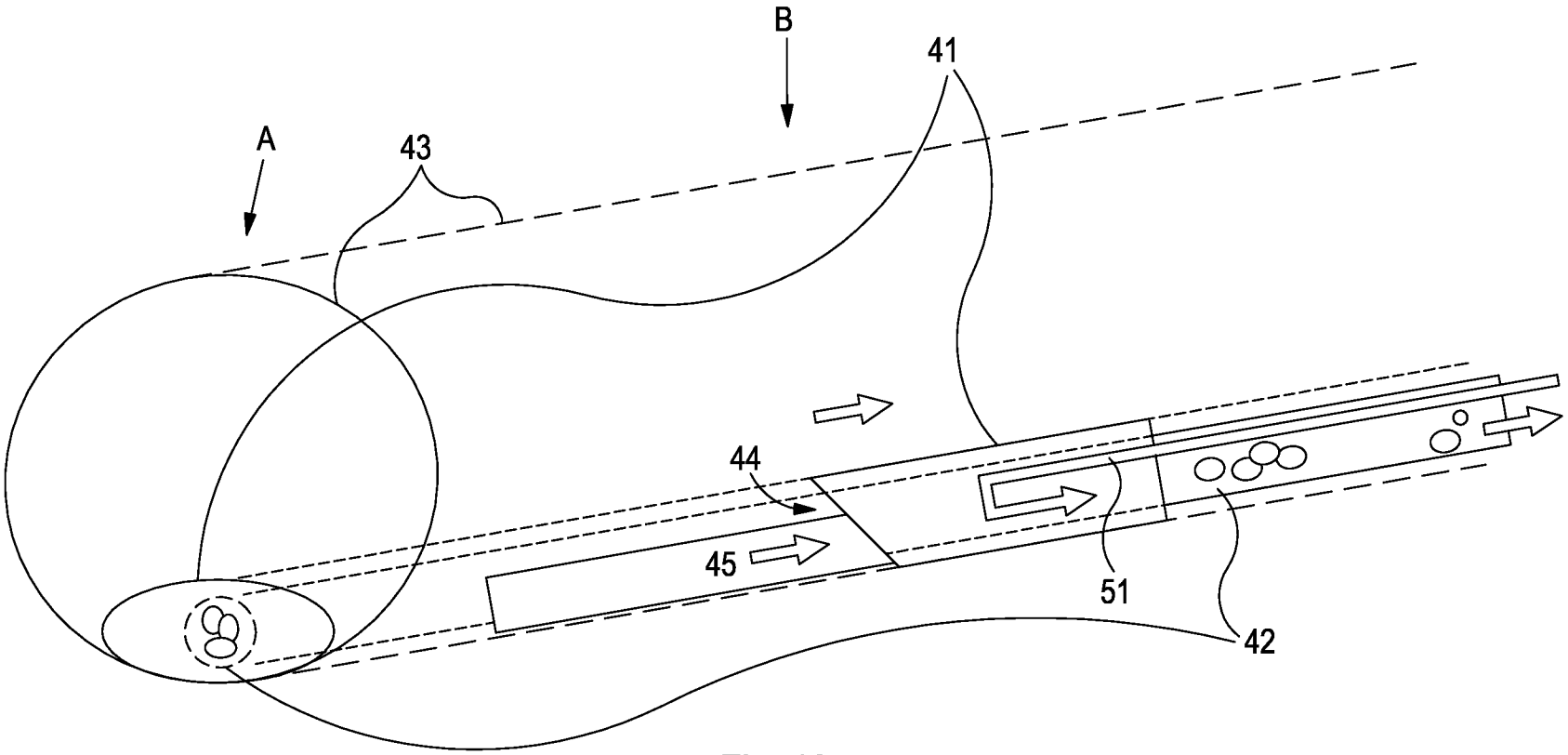
FIG. 13 illustrates a surge protection system.

FIG. 13 illustrates a further example. The same reference numbers as those in FIG. 12 correspond to the same components as described previously. The methods disclosed herein could also be used in deep water risers, or within a well, where the pressure differential between a high pressure tank, such as tank 4 in FIG. 11, and a low pressure tank, such as tank 8 or device 40 in FIG. 11, at the topside is not sufficient to lift a single phase liquid all the way from the sea bed to the topside within the flexible tubing. The suction as a result of the pressure differential may not be sufficiently strong to transport the liquid upwards over a long distance. If the suction is not sufficient, gas lift could be used to start the flow of liquid within the flexible tubing. FIG. 13 illustrates a gas nozzle 51 arranged within the flexible tubing and terminating within or near the intake device 41 such that gas flow can be provided to start the flow into the flexible tubing or to support continuous flow within the flexible tubing. The lift gas can be sent from the topside (or well head) using concentric coiled tubing (i.e. pipe-in-pipe) on a coil. Alternatively, parallel strings of regular coiled tubing bound together side by side can be used.

Figure 14:
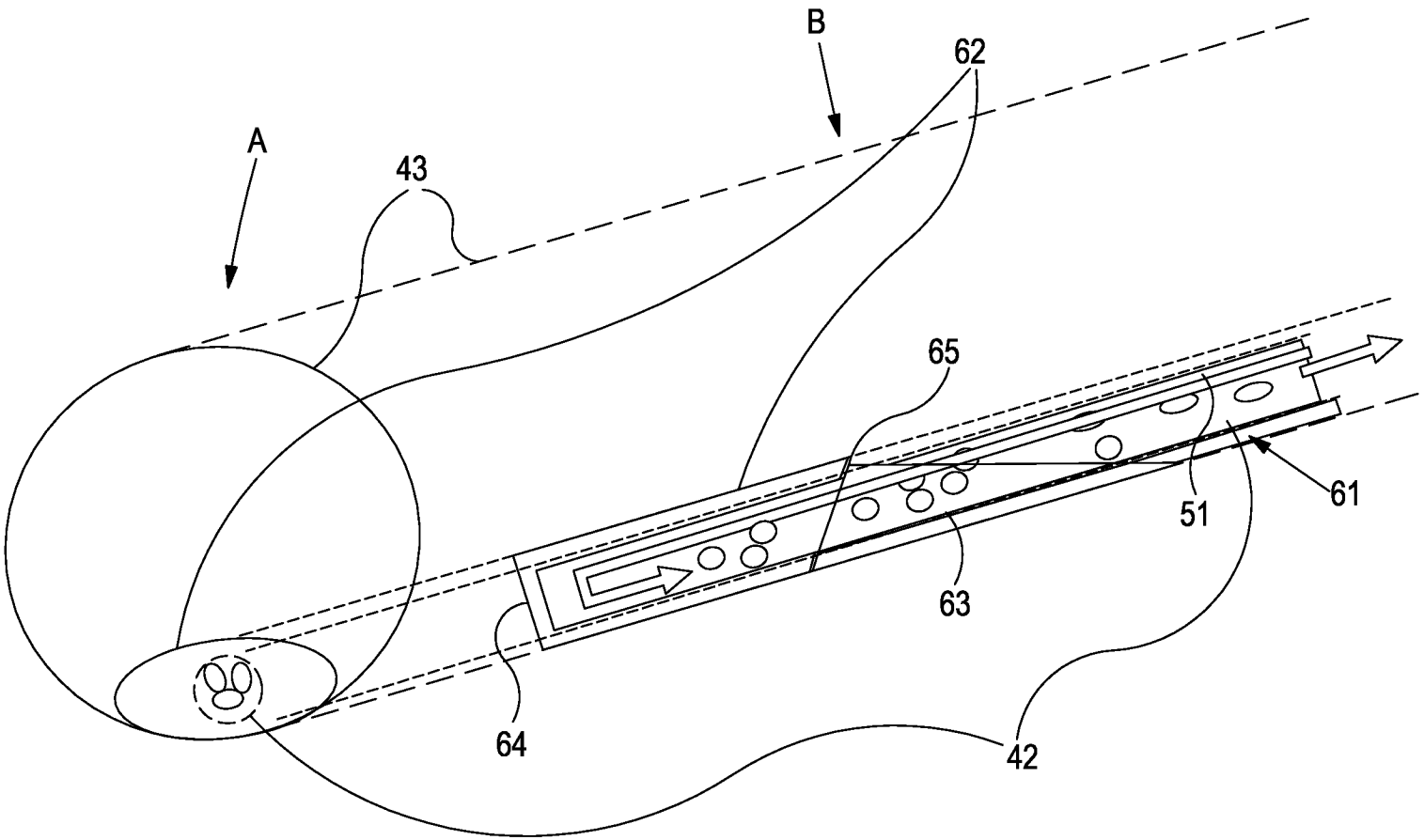
FIG. 14 illustrates a surge protection system.

FIG. 14 illustrates a further example. The same reference numerals as in FIGS. 4 and 5 correspond to the same components. The flow of liquids is now different from the flow illustrated in FIGS. 4 and 5. The liquid 61 flows downwards within the pipe section above the intake device 62. The intake device is shaped such that the downwards flow is captured and channelled into the flexible tubing. Liquid accumulates above the inflow device as illustrated by shaded area 63 before being pumped upstream by the pressure differential. The end portion 64 of the intake device facing downwards is closed while the end portion 65 of the intake device facing upwards is open to receive the fluid.

Figure 15A:
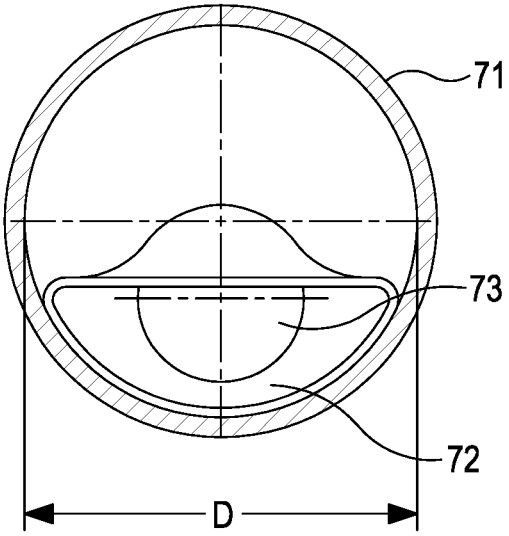
FIG. 15*a* is a radial cross section through a riser with an intake device.
Figure 15B:
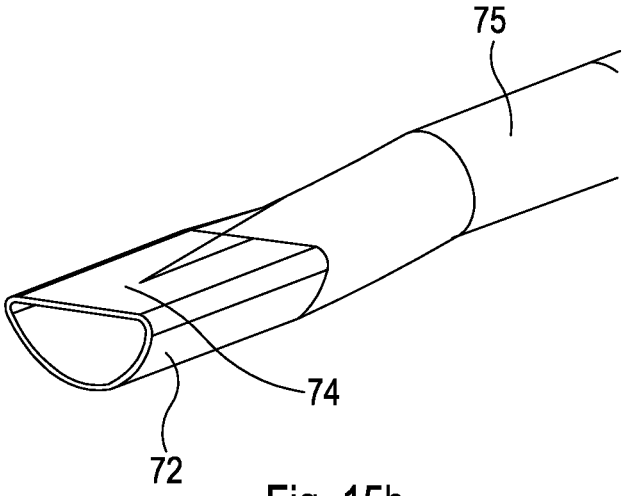
FIG. 15*b* is a perspective view of an intake device and tubing.

FIG. 15*a* illustrates a radial cross section through a riser 71 in which an intake device 72 and flexible tubing 73 are provided. FIG. 15*b* illustrates a perspective view of the intake device and flexible tubing. As illustrated, intake device is biased against the inner wall of the riser by gravity. The lower part of the intake device has curvature which matches the curvature corresponding to inner diameter D of the riser. As a result, the lower part of the intake device is flush with the inner wall of the riser. A fluid film which is present at the lower part of the riser will be drawn into the intake device when the flexible tubing is at a lower pressure than the riser. The upper part 74 of the intake device is flat so as to reduce the amount of gas which is drawn into the flexible tubing. The upper part of the can also have other shapes than the flat shape illustrated in FIGS. 15*a* and 15*b*, for example a convex or concave shape.

Examples are set out below in the form of numbered clauses:

1. A system for surge protection of a riser adapted to transport gas from a hydrocarbon production well or for surge protection in a well, the system comprising:
   a flexible tubing, wherein a portion of the flexible tubing extends into the riser or into the well and wherein the tubing terminates inside the riser or inside the well;
   a pressure control system arranged to create a pressure differential within the flexible tubing such that liquid is drawn from the riser or the well into the flexible tubing if liquid is present in the riser or the well.

2. The system of clause 1,
wherein the surge comprises a liquid film accumulated against an inner wall of the riser or the well;
   wherein the pressure control system comprises a pressure communication channel between the riser or the well and a first stage separator, and a pressure communication channel between the flexible tubing and a device with a lower pressure than the first stage separator;
   wherein the flexible tubing is connected to an intake device, wherein intake device terminates at an end portion, wherein the end portion comprises a partially tubular outer wall, wherein the outer curvature of the partially tubular outer wall matches the inner curvature of the inside wall of the riser or the well; and
wherein in use the partially tubular outer wall is biased against the inside wall of the riser or the well.

3. The system of clause 1 or 2, further comprising a reel for storing a further portion of the flexible tubing and for varying the length of said portion of the flexible tubing extending into the riser or into the well.

4. The system of any one of the preceding clauses, further comprising a pressure sensor arranged to measure the pressure in the flexible tubing.

5. The system of clause 4, further comprising a control system arranged to increase the length of said section if the pressure in the tubing is below a first threshold level and arranged to decrease the length of said section if the pressure in the tubing is above a second threshold level.

6. The system of clause 5, wherein the first threshold level and the second threshold level are the same, or wherein the second threshold level is higher than the first threshold level.

7. The system of any one of the preceding clauses, further comprising a detector arranged to detect the presence of fluid or amount of fluid in the flexible tubing.

8. The system of clause 7, further comprising a control system arranged to:
increase the length of said section if the amount of detected fluid is below a first threshold level, or if no fluid is detected;
the control system further arranged to:
decrease the length of said section if the amount of detected fluid is above a threshold.

9. The system of clause 2, wherein the device with a lower pressure than the first stage separator comprises one or more of:
a low pressure tank and a valve;
a second or higher stage separator.

10. The system of any one the preceding clauses, wherein the pressure control system comprises a multiphase pump.

11. The system of any one of clauses 1 and 2 to 8, wherein the pressure control system comprises a first connection between the well and a first flowline and a second connection between the flexible tubing and a second flowline, and wherein the pressure in the first flowline is higher than the pressure in the second flowline.

12. The system of any one of the preceding clauses, further comprising a return system for returning fluid extracted by the flexible tubing back to the production process.

13. The system of clause 12, therein the return system comprises a multiphase pump.

14. The system of clause 1, wherein said pressure control system comprises a separator connected to said flexible tubing.

15. The system of clause 14, wherein the riser or well is connected to a further separator and wherein the further separator has a lower pressure than the separator connected to the flexible tubing.

16. The system of any one of the preceding clauses, further comprising a spacer arranged to urge the end of the flexible tubing against an inner wall of the riser or well.

17. The system of any one of the preceding clauses, further comprising a weight arranged to urge the end of the flexible tubing against an inner wall of the riser or well.

18. The system of clause 1, wherein the end of the flexible tubing is attached to an intake device, wherein the intake device has an at least partially oval cross section in radial direction of the flexible tubing, or wherein intake device terminates at an end portion, wherein the end portion comprises a partially tubular outer wall, wherein the outer curvature of the partially tubular outer wall matches the inner curvature of the inside wall of the riser.

19. The system of any one of the preceding clauses, wherein the end of the flexible tubing is attached to an intake device, wherein the intake device is open and able to receive fluid on the side of the intake device facing the flexible tubing, and wherein the intake device is closed on the side of the intake device facing away from the flexible tubing.

20. The system of any one of the preceding clauses, further comprising a gas flowline terminating at or near the position where the flexible tubing terminates, wherein the gas flowline is suitable for injecting gas into the flexible tubing for providing gas lift.

21. A method for protecting a riser adapted to transport gas from a hydrocarbon production well against pressure surges or for protecting a well against pressure surges, the method comprising:

extending a portion of a flexible tubing into the riser or into the well, wherein the tubing terminates inside the riser or the well;

drawing liquid from the riser or well into the flexible tubing if liquid is present in the riser or well by creating a pressure differential within the flexible tubing with a pressure control system.

22. A method according to clause 21, wherein the surge comprises a liquid film attached to an inner wall of the riser or the well;

wherein creating the pressure differential comprises providing a pressure communication channel between the riser or the well and a first stage separator, and providing a pressure communication channel between the flexible tubing and a device with a lower pressure than the first stage separator;

wherein the flexible tubing is connected to an intake device, wherein intake device terminates at an end portion, wherein the end portion comprises a partially tubular outer wall, wherein the outer curvature of the partially tubular outer wall matches the inner curvature of the inside wall of the riser of the well; and wherein the method further comprises biasing the partially tubular outer wall of the end portion against the inside wall of the riser.

23. The method of clause 21 or 22, wherein the method further comprises varying the length of said portion of the flexible tubing by rolling or unrolling the flexible tubing on a reel.

24. The method of any one clauses 21 to 23, further comprising determining the pressure within the flexible tubing and varying the length depending on said determining, or adapting the pressure within the flexible tubing in response to said determining.

25. The method of any one of clauses 21 to 24, further comprising determining the amount of liquid within the flexible tubing and varying the length depending on said determining.

26. The method of any one of clauses 21 to 25, wherein said drawing of liquid comprises regulating a valve to a low pressure reservoir.

27. The method of any one of clauses 21 to 25, wherein said drawing of liquid comprising controlling a pump.

28. The method of any one of clauses 21 to 27, further comprising transporting fluid from the flexible tubing to a production facility.

29. The method of any one of clauses 21 to 28, further comprising connecting said riser or well to a first stage separator and connecting said flexible tubing to a second or higher stage separator and wherein the pressure of the further separator is lower than the pressure of the first separator.

30. The method of any one of clauses 21 to 28, further comprising connecting the flexible tubing to a first flowline and connecting the well to a second flowline.

31. The method of any one of clauses 21 to 29, further comprising urging the end of the flexible tubing against an inner wall of the riser or well.

32. The method of any one of clauses 21 to 31, further comprising starting the flow of liquid into the flexible tubing at a first depth of the riser or the well, and lowering the flexible tubing to a second depth of the riser or the well, wherein the second depth is further upstream than the first depth.

33. The method of any one of clauses 21 to 31, further comprising varying the pressure with the pressure control system.

34. The method of clause 23, further comprising cutting the flexible tubing after said step of varying, hanging off the tubing from the riser, connecting to said pressure control system.

35. The method of any one of clauses 21 to 34, further providing a gas flowline and injecting gas into the flexible tubing.

The invention claimed is:

1. A method of separating fluid phases in a well or riser, comprising:

locating an inlet device at a substantially horizontal portion of the well or riser, wherein a portion of a flexible tubing extends into the well or riser and the flexible tubing terminates at the inlet device;

biasing the inlet device against an inside wall of the well or riser; and extracting a stratified fluid phase from the well or riser through the inlet device and flexible tubing, wherein the inlet device comprises a curved portion matching the shape of part of the inside wall, wherein the inlet device comprises a partially tubular outer wall, the curved portion of the inlet device is an outer curvature of the partially tubular outer wall which matches an inner curvature of the inside wall of the riser or the well, corresponding to an inner diameter of the well or riser, and the inlet device is biased against the inside wall of the well or riser such that the inlet device is flush with the inside wall of the well or riser, and wherein radii of the outer curvature of the partially tubular outer wall and the inner curvature of the inside wall of the riser or the well are the same.

2. The method of claim 1, wherein biasing the inlet device against the inside wall of the well or riser comprises biasing the inlet device away from an opposing inside wall of the well or riser.

3. The method of claim 1, wherein the inlet device has an at least partially oval cross section in radial direction of the flexible tubing.

4. The method of claim 1, wherein the inlet device comprises a jet pump.

5. The method of claim 1, wherein the inlet device is biased against the inside wall of the well or riser using a spacer arranged to urge the end of the flexible tubing and/or the inlet device against the inside wall.

6. The method of claim 1, wherein the inlet device is biased against the inside wall of the well or riser using a weight that is arranged to urge the end of the flexible tubing and/or the inlet device against the inside wall.

7. The method of claim 1, wherein the inlet device is biased against a lower inside wall of the well or riser.

8. The method of claim 1, wherein the extracted stratified fluid phase is a water phase or a water-and-condensate phase.

9. The method of claim 1, wherein the inlet device is biased against an upper inside wall of the well or riser.

10. The method of claim 9, wherein the extracted stratified fluid phase is an oil phase or an oil-and-gas phase.

11. The method of claim 1, wherein the inlet device includes a flat portion connected to the curved portion, a curvature of the curved portion in its entirety conforms to the inner curvature of the inside wall of the riser or the well, and the flat portion is parallel with a longitudinal axis of the inlet device.

12. The method of claim 1, wherein an open end of the inlet device is D-shaped, and a maximum width of the open end in a horizontal direction is larger than a maximum height of the open end in a vertical direction that is perpendicular to the substantially horizontal portion of the well or riser.

13. A system for separating fluid phases in a well or riser, comprising:

a flexible tubing extending into the well or riser and terminating at an inlet device, wherein the inlet device is located at a substantially horizontal portion of the well or riser and is biased against an inside wall of the well or riser;

wherein the inlet device comprises a curved portion and a shape of the curved portion of the inlet device is configured to match a shape of the inside wall, corresponding to an inner diameter of the wall of the well or riser, and wherein the inlet device and flexible tubing are configured to extract a stratified fluid phase from the horizontal portion of the well or riser, and wherein radii of an outer curvature of the curved portion of the inlet device and an inner curvature of the inside wall of the riser or the well are the same.

* * * * *